United States Patent [19]

Kusumoto

[11] Patent Number: 4,868,605

[45] Date of Patent: Sep. 19, 1989

[54] COPYING APPARATUS CAPABLE OF FORMING VARIOUS TYPES OF IMAGES

[75] Inventor: Keiji Kusumoto, Osaka, Japan

[73] Assignee: Milolta Camera Kabushiki Kaisha, Osaka, Japan

[21] Appl. No.: 266,990

[22] Filed: Nov. 10, 1988

[30] Foreign Application Priority Data

Nov. 13, 1987 [JP] Japan ..... 62-287785

[51] Int. Cl.[4] ..... G03G 15/00; G03G 15/01

[52] U.S. Cl. ..... 355/218; 355/202; 355/210; 355/244; 355/260; 355/326

[58] Field of Search ..... 355/218, 202, 210, 244, 355/260, 245, 326

[56] References Cited

U.S. PATENT DOCUMENTS

| | | | |
|---|---|---|---|
| 4,639,119 | 1/1987 | Isaka | 355/260 X |
| 4,640,601 | 2/1987 | DeGuchi et al. | 355/218 |
| 4,679,927 | 7/1987 | Sogo et al. | 355/218 |
| 4,690,541 | 9/1987 | Sakai et al. | 355/326 X |
| 4,692,018 | 9/1987 | Tamura | 355/260 |
| 4,707,109 | 11/1987 | Kanno et al. | 355/218 |
| 4,710,016 | 12/1987 | Watanabe | 355/326 |
| 4,720,730 | 1/1988 | Ito | 355/4 |
| 4,723,146 | 2/1988 | Kasahara | 355/326 |
| 4,757,344 | 7/1988 | Idenawa et al. | 355/260 |
| 4,761,673 | 8/1988 | Watanabe et al. | 355/218 X |

FOREIGN PATENT DOCUMENTS

| | | |
|---|---|---|
| 51-134635 | 11/1976 | Japan . |
| 54-30833 | 3/1979 | Japan . |

OTHER PUBLICATIONS

U.S. patent application Ser. No. 16,716, filed Feb. 19, 1987.

U.S. patent application Ser. No. 16,717, filed Feb. 19, 1987.

U.S. patent application Ser. No. 46,944, filed May 7, 1987.

U.S. patent application Ser. No. 58,266, filed May 21, 1987.

U.S. patent application Ser. No. 71,261, filed Jul. 8, 1987.

U.S. patent application Ser. No. 71,263, filed Jul. 8, 1987.

U.S. patent application Ser. No. 117,836, filed Nov. 9, 1987.

U.S. patent application Ser. No. 119,833, filed Nov. 12, 1987.

*Primary Examiner*—A. C. Prescott

*Attorney, Agent, or Firm*—Willian Brinks Olds Hofer Gilson & Lione

[57] ABSTRACT

Three mounting portions are provided along a direction of rotation of a photoreceptor, on the downstream side of an eraser and a corona charger. A first developing unit, an outline unit and a second developing unit are mounted in this order from the upstream side. The units can be attached to and detached from the mounting portions. When an outline mode is designated, the color of the developing unit mounted on the downstream side of the outline unit is displayed on a display portion. When one color is designated out of the displayed colors, the developing unit of that color is operated to carry out a copying operation in the outline mode. When the color is not designated, the copying operation is carried out by a developing unit having a prescribed color mounted on the downstream side of the outline unit.

7 Claims, 10 Drawing Sheets

COPYING APPARATUS CAPABLE OF FORMING VARIOUS TYPES OF IMAGES

BACKGROUND OF THE INVENTION

1. Field of the Invention

The present invention generally relates to a copying apparatus and, more specifically, to a copying apparatus having a function of forming color copies as well as a function of forming outline images.

2. Description of the Prior Art

Recently, devices capable of forming not only black images but color images such as red, blue and so on have been developed in the field of image forming apparatuses such as copying machines employing electrophotography process. More specifically, a plurality of developing devices are arranged around a photoreceptor, and a color developing device containing developer with color toner can be selectively mounted and used by replacing other color developing devices.

In consideration of the recognition that an outline of an image is very important, comprising much information and representing characteristics of the image, the applicant of the present application has proposed a method for forming an outline image, in which a second charging apparatus is provided between an image exposing apparatus and a developing device, and only outlines of a picture are extracted to form outline images, and line images are directly reproduced as the line images by the operation of the second charging apparatus (disclosed in U.S. Ser. No. 16,716 and U.S. Ser. No. 16,717).

Let us consider a case in which the function of forming outline images is implemented in a unit (hereinafter referred to as an outline unit) compatible with the developing devices, and the unit is mounted on a copying machine capable of mounting a plurality of developing devices in place of one of the developing devices. In order to turn a latent electrostatic image of the outline portion to a toner image by a developing device, the outline unit must be arranged on the upstream side of at least one developing device in association with the direction of movement of a photoreceptor so as to enable selection of developing devices arranged on the downstream side of the outline unit, in order to prevent miscopying.

If there are a plurality of developing devices which can be selected, the copying apparatus should preferably be controlled to prevent operational error as much as possible, without prohibiting image formation even in the case the image formation is started with the developing device not selected.

SUMMARY OF THE INVENTION

An object of the present invention is to provide an electrophotographic copying apparatus having an outline forming unit which can be handled easily.

Another object of the present invention is to provide an electrophotographic copying apparatus having an outline forming unit capable of reducing miscopies.

A further object of the present invention is to provide an electrophotographic copying apparatus having an outline forming unit capable of copying without selecting a developing unit.

In order to attain the above described objects, the electrophotographic copying apparatus of the present invention comprises, in a broad way, a photoreceptor; a plurality of mounting portions; first image forming means; a plurality of developing units; detecting means; unit determining means; mode defining means; and control means. The photoreceptor is movable. The plurality of mounting portions are arranged in the vicinity of the photoreceptor and along a direction of movement of the photoreceptor. The first image forming means can be mounted to each of the mounting portions, and forms a first latent electrostatic image on the photoreceptor, when mounted on any of the mounting portions. Each of the plurality of developing units can be attached to and detached from each of the mounting portions, and develops the latent electrostatic image formed on the photoreceptor, when mounted on any of the mounting portions. The detecting means detects the position of mounting of the first image forming means mounted on any one of the mounting portions, and the developing units mounted on the downstream side of the mounting portion of the first image forming means, in the direction of movement of the photoreceptor. The unit determining means determines one developing unit out of the developing units detected by the detecting means. The mode defining means defines the copying mode of the first image forming means. The control means activates the first image forming means in response to an output from the mode defining means, and develops the first latent electrostatic image by means of the developing unit determined by the unit determining means.

In order to attain the above described objects, the electrophotographic copying apparatus of the present invention comprises, in a certain aspect, a photoreceptor; image forming means; mounting portions; developing units; an outline unit; detecting means; mode selecting means; developing color selecting means; display means; memory means; and control means. The photoreceptor is movable. The mounting portions are arranged in the vicinity of the photoreceptor and along a direction of movement of the photoreceptor. Each of the developing units can be attached to and detached from each of the mounting portions, and develops a latent electrostatic image on the photoreceptor, when mounted on a mounting portion. The outline unit can be attached to and detached from each of the mounting portions, and applies charges on the latent electrostatic image on the photoreceptor while being mounted on a mounting portion to form a latent electrostatic image with the outline portions emphasized. The detecting means detects the developing color of the developing units mounted on each of the mounting portions, and the mounting portion on which the outline unit is mounted. The mode selecting means selects an outline copying mode. The developing color selecting means selects any one of at least one developing unit mounted on the mounting portions. The display means displays at least one developing color of at least one developing unit mounted on the downstream side of the mounting portion of the outline unit in the direction of movement of the photoreceptor, based on an output from the detecting means, when the outline copying mode is selected by the mode selecting means. The memory means stores the developing color of the developing unit which is selected before the outline copying mode is selected by the mode selecting means by the developing color selecting means. The control means operates, when the outline mode is selected by the mode selecting means and thereafter the developing unit is selected by the developing color selecting means, the outline unit and the selected developing unit to carry out copying, and operates, when the outline mode is selected by the mode selecting means but the developing unit is not selected by the developing color selecting means, the outline unit and the developing unit of the developing color stored in the memory means to carry out copying.

In the electrophotographic copying apparatus structured as described above, when the copying mode of the first image forming means is defined, the development is carried out by the developing unit which is selected from developing units capable of developing first latent electrostatic images, whereby the desired copies can be surely provided in the defined copying mode.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described in the following with reference to appended drawings.

(a) Structure of the copying machine

Figure 1:
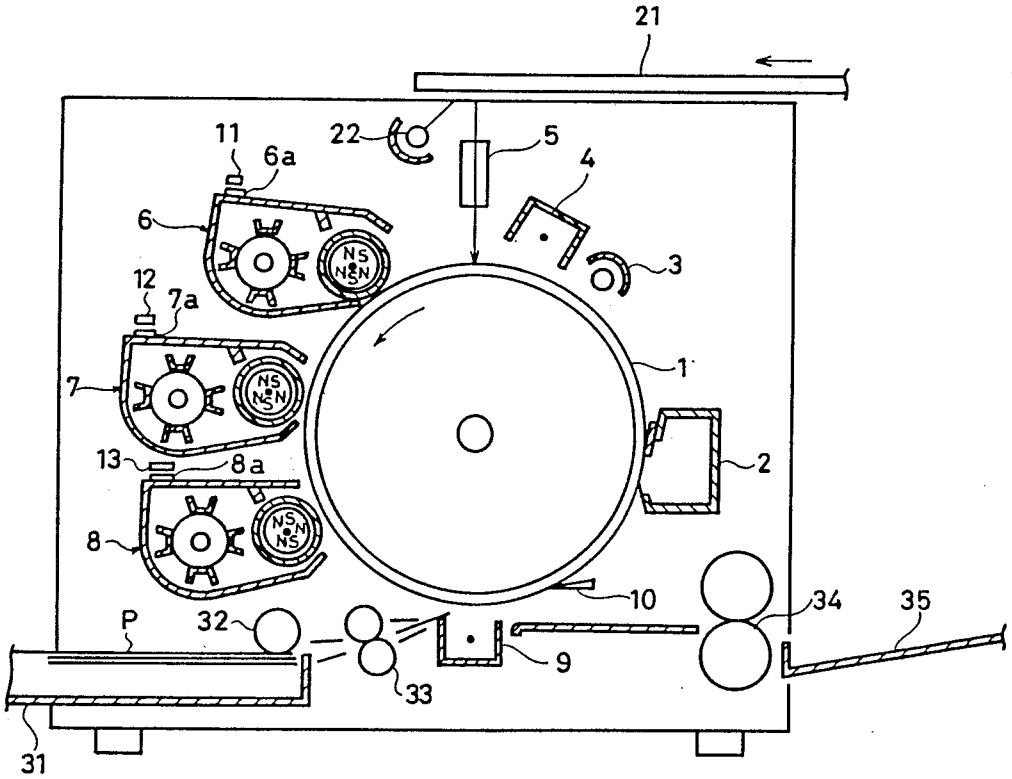
FIG. 1 is a cross sectional view showing a schematic structure of a copying machine in accordance with one embodiment of the present invention.

FIG. 1 is a schematic cross sectional view of the copying machine in accordance with one embodiment of the present invention.

Around a photoreceptor drum 1 are provided a blade type cleaning apparatus 2, an eraser lamp 3, a corona charger 4, a lens array 5, developing units 6, 7 and 8 detachably attached to respective mounting portions at the upper stage, middle stage and the lower stage of the copying machine body, a transfer charger 9, and a separating pawl 10.

An original placed on an original glass support 21 is irradiated by an exposure source 22. Light reflected from the original irradiates the photoreceptor drum through the lens array 5. The original is scanned by the movement of the original glass support. The charged photoreceptor drum 1 receives the image exposure to form a latent electrostatic image. Toner is applied on the latent electrostatic image by the above described developing units 6, 7 or 8. The toner image on the photoreceptor drum is transferred onto a paper by the transfer charger 9. Papers P on which the toner image is to be transferred are contained in a paper feeding cassette 31. The paper is fed by a paper feeding roller 32 to a timing roller 33. The timing roller 33 feeds the paper transferred from the paper feeding cassette with the front edge of the paper aligned with the toner image forming region on the photoreceptor drum 1. The toner image is transferred onto the fed paper by the transfer charger 9. The paper is then separated from the surface of the photoreceptor drum 1 by the separating pawl 10. The toner is heat fixed by a fixing roller 34, and the paper is discharged to a discharge tray 35. A driving motor (main motor), not shown, is provided in the copying machine, which drives the photoreceptor 1, the paper feeding roller 32, the timing roller 33, the developing units 6, 7 and 8, the fixing roller 34, and so on. The main motor can be connected to the paper feeding roller 32, the timing roller 33 and to the developing unit 6, 7 and 8 by a clutch or the like (not shown) so that each of these components can operate independently.

The developing units 6, 7 and 8 are detachably mounted on respective mounting portions at the upper stage, middle stage and lower stage of the body of the copying machine, as shown in FIG. 1. The developing color can be changed by mounting a developing unit having toner of different color, which is separately prepared, onto any of the mounting portions in place of the mounted developing unit. Connectors 11, 12 and 13 are arranged at respective mounting portions and are connected to DIP switches *6a*, *7a* and *8a* provided on upper surfaces of the mounted developing units 6, 7 and 8. Each of the DIP switches *6a*, *7a* and *8a* comprises three contacts, and represents 3 bit code in accordance with the open/close condition of these three contacts. Different 3 bit codes are allotted, corresponding to the toner colors, to respective developing units 6, 7 and 8. A service man or a user can mount a developing unit to the mounting portion of the body, with the open/close state of the contacts of the DIP switch of that developing unit corresponding to the code allotted in association with the desired toner color. The 3 bit code signals from the DIP switches of the mounted developing units are inputted to a CPU 100, which will be described later, through the connectors 11, 12 and 13. The CPU 100 identifies the toner colors of the developing units mounted on the respective mounted portions based on the signals.

Figure 2:
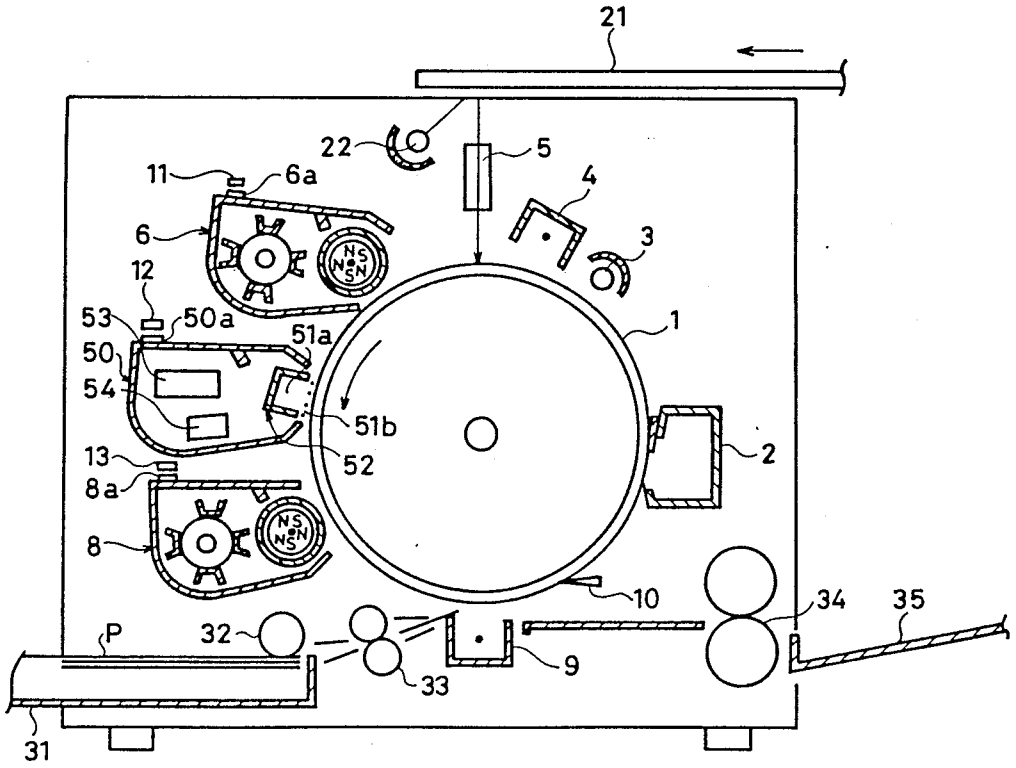
FIG. 2 is a cross sectional view showing a schematic structure of the copying machine of FIG. 1 when an outline unit is mounted thereto.

FIG. 2 shows the copying machine of FIG. 1 in which the outline unit 50 is mounted on the mounting portion at the middle stage instead of the developing unit 7. The appearance of the outline unit 50 is the same as the developing units 6, 7 and 8, and it can be mounted to each of the mounting portions in place of the developing unit 6, 7 or 8. In this example, it is mounted on the position of the unit 7. The DIP switch *50a* is provided on the upper surface of the outline unit 50 as in the case of the developing units, and the 3 bit code signal is inputted to the CPU 100 through the connector 12. The mounting of the outline unit 50 is identified based on this signal. In this case, the developing unit 8 positioned on the downstream side of the outline unit 50 in the direction of rotation of the photoreceptor 1 can be operated not only in the normal operation mode but also in the outline mode.

The outline unit 50 comprises a scorotron charger 52 formed of a corona discharge electrode (charge wire) 51*a* and a grid 51*b* arranged between the corona discharge electrode and the photoreceptor drum 1, and first and second high voltage power supplies 53 and 54 for applying negative and positive direct current voltages to the corona discharge electrode 51*a* and to the grid 51*b*, respectively.

Figure 3:
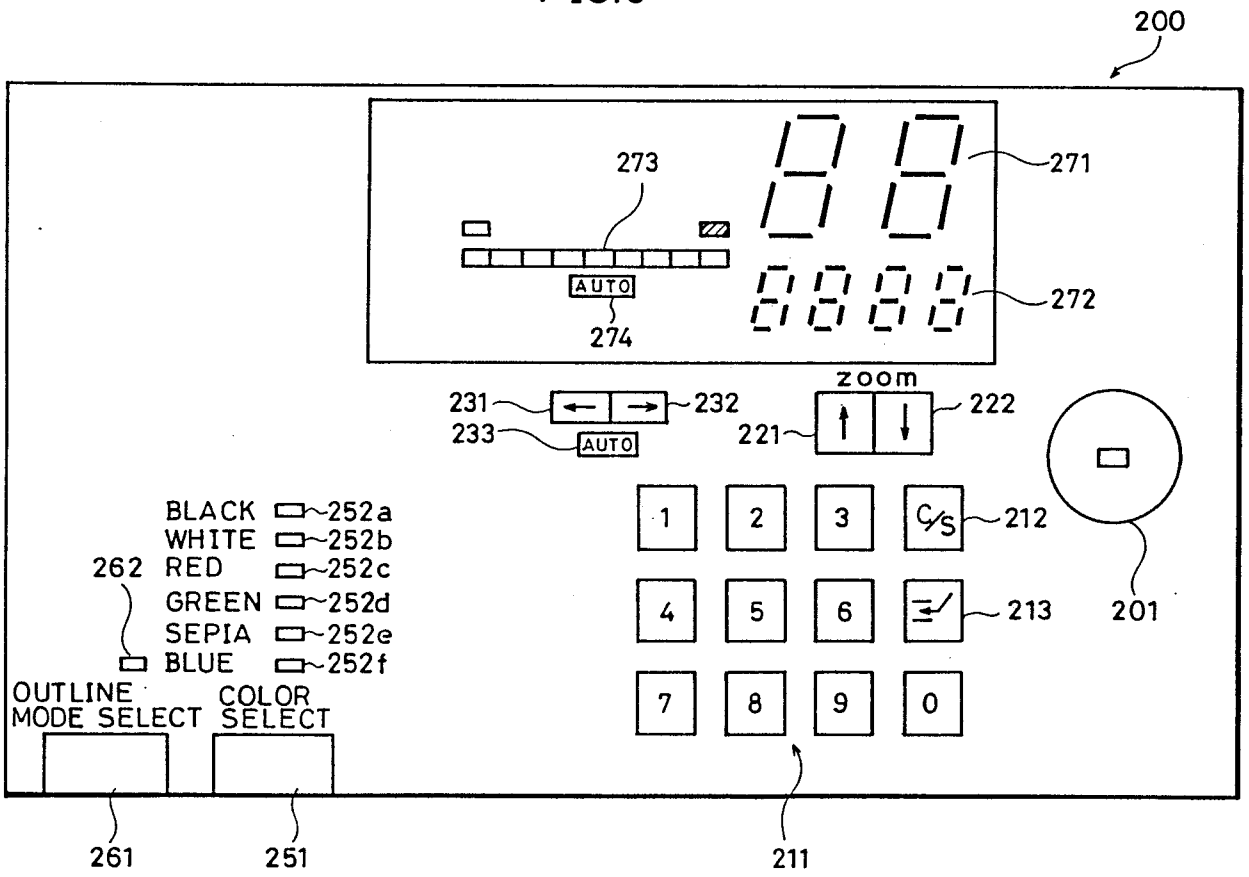
FIG. 3 is a plan view showing a structure of an operation panel of the copying machine in accordance with one embodiment of the present invention.

FIG. 3 shows an operation panel 200 attached to the body of the copying machine shown in FIG. 1 arranged on the operation panel 200 are: a print key 201 instructing start of copying; ten keys 211 for inputting number of copies; a clear/stop key 212; an interruption key 213; zoom keys 221 and 222 for increasing and decreasing magnification rate, respectively; keys 231 and 232 for increasing and decreasing an amount of exposure in manual exposure; an AUTO switching key 233 for designating automatic adjustment of the amount of exposure; a color select key 251 for selecting a developing unit for the development; LED displays 252*a* to 252*f* indicating the color of the selected developing unit (black, white, red, green, sepia and blue); an outline mode select key 261 switching between the normal mode and the outline mode; an LED display 262 which is lit up when the outline mode is selected by the outline mode select key 261; numeral display 271 of two digits indicating the number of copies; numeral display 272 of 4 digits indicating the copying magnification rate; exposure step display 273 indicating the amount of exposure by 9 steps; and an AUTO display 274 indicating the automatic exposure mode.

Figure 4:
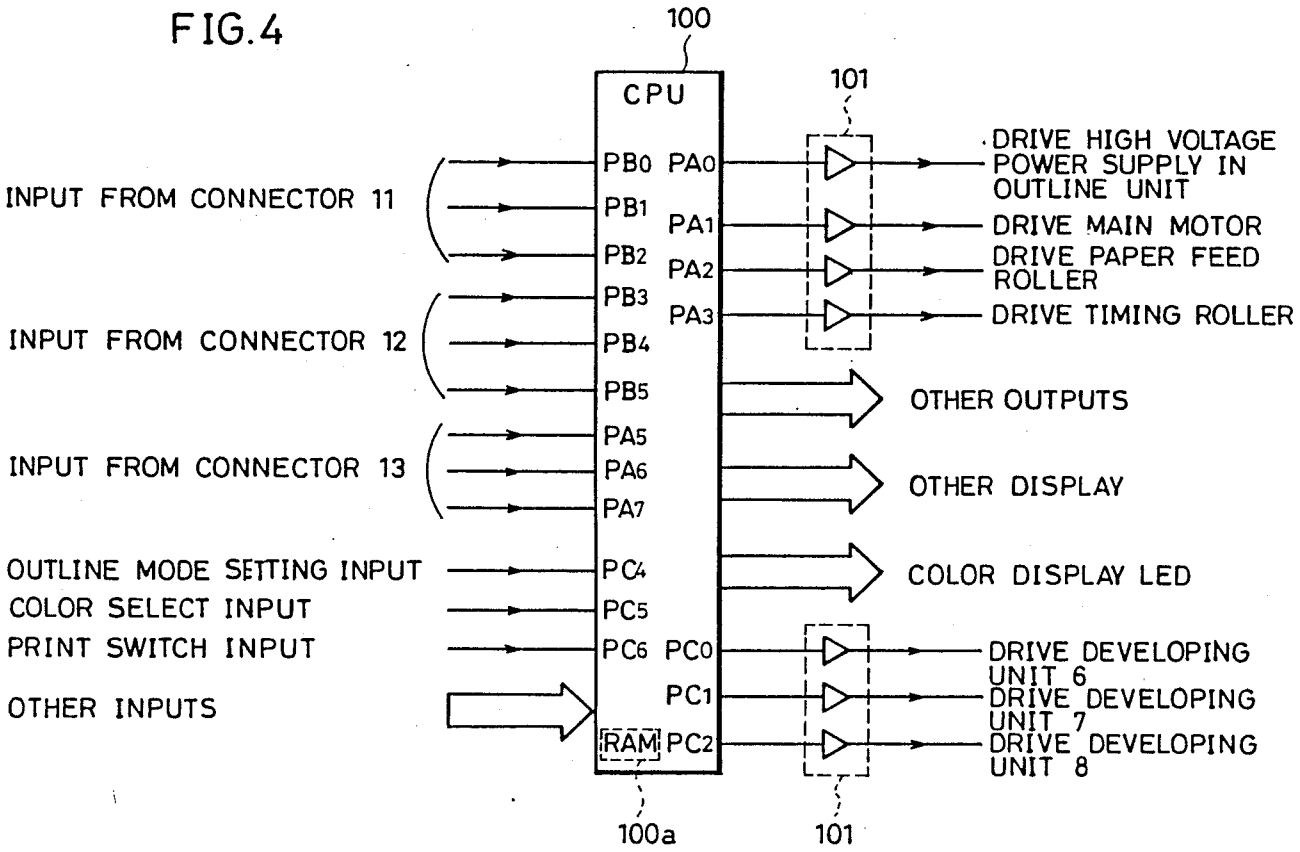
FIG. 4 is a schematic diagram showing a structure of a control system of the copying machine in accordance with one embodiment of the present invention.

FIG. 4 is a schematic diagram showing the control circuit in association with the CPU in accordance with one embodiment of the present invention. The CPU 100 takes information for the control of the copying machine, and sends information to peripheral circuits.

Output ports PA0, PA1, PA2 and PA3 for outputting signals to a driver IC 101 for driving the main motor and the like are provided on the CPU 100. Control signals for controlling the high voltage power supplies in the outline unit, the main motor driving portion and the paper feeding roller driving clutch are outputted from these output ports.

Output ports PC0, PC1 and PC2 output control signals for controlling clutches driving the developing units 6, 7 and 8. Input ports PB0 to PB5 and PA5 to PA7 receive 3 bit code signals through the connectors 11, 12 and 13 for identifying the units and the colors of the toner in the developing devices respectively mounted on the above mentioned units 6, 7 and 8. Each of the 3 bit code signals enables identification of the color of toner and the unit. Input ports PC4, PC5 and PC6 receive signals from the outline mode select key 261, the color select key 251 and the print key 201 on the operation panel 200.

(b) Outline forming mode

Figure 5:
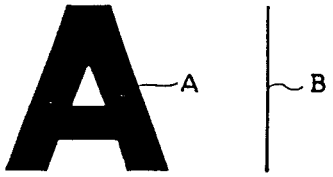
FIG. 5 shows examples of latent electrostatic images formed by the copying machine in accordance with one embodiment of the present invention.
Figure 6:
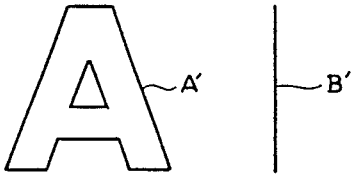
FIG. 6 shows one examples of the latent electrostatic images shown in FIG. 5 with the outline portions emphasized by the outline unit.

A method for forming outline images will be described (see the related application U.S. Ser. No. 16,716). By this method, an outline image (A') shown in FIG. 6 can be formed from the picture image (A) of FIG. 5 by extracting only the outline portions thereof. The line image (B) of FIG. 5 can be reproduced directly as the line image (B') of FIG. 6.

Figure 7A:
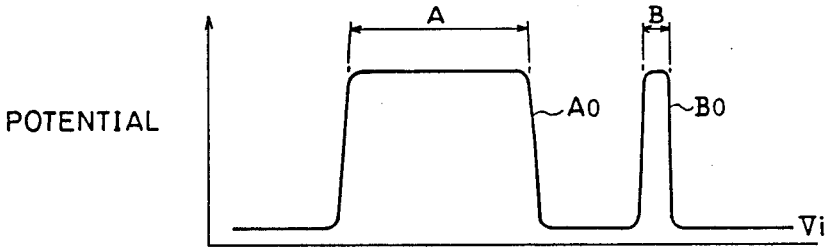
FIGS. 7A to 7C show the potential of the latent electrostatic a photoreceptor in the outline forming mode.
Figure 7B:
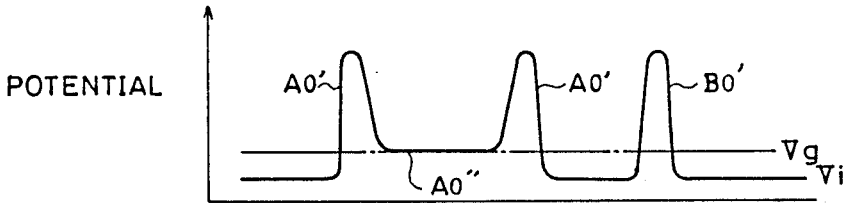

The principle of forming of outline images will be described with reference to FIGS. 7A, 7B, 7C and 8. First, a surface of the photoreceptor drum 1 rotating in the direction of the arrow (FIG. 2) is uniformly charged by a corona charger 4, and thereafter the images are exposed by an optical system. Consequently, latent electrostatic images ($A_0$) and ($B_0$) corresponding to the picture image (A) and line image (B) are formed as shown in FIG. 7A.

Thereafter, a negative high voltage is applied to the charge wire 51*a* of the scorotron charger 52 of the outline unit 50 while a grid voltage $V_g$ lower than the surface potential of said latent electrostatic images $A_0$ and $B_0$ is applied to the grid 51*b*. Consequently, the charger negative charges from the charge wire 51*a* reach the central portion of the picture image with the electric line of force extending in the direction of the grid 51*b*, and therefore the potential of the portions other than the outline portion $A_0'$ of the latent electrostatic image $A_0$ of the picture image are lowered to said grid voltage $V_g$. As for the latent electrostatic image $B_0$ of the line image, the electric line of force do not extend to the direction of the grid 51*b*, and therefore the latent electrostatic image $B_0'$ is maintained as it is.

Figure 7C:
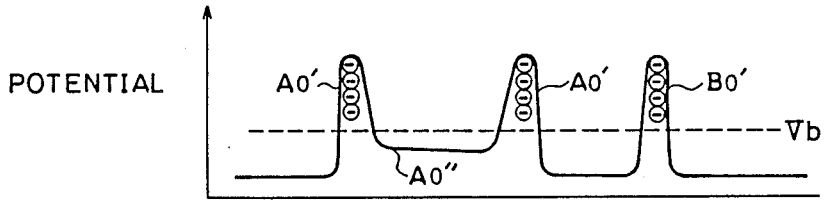
Figure 8:
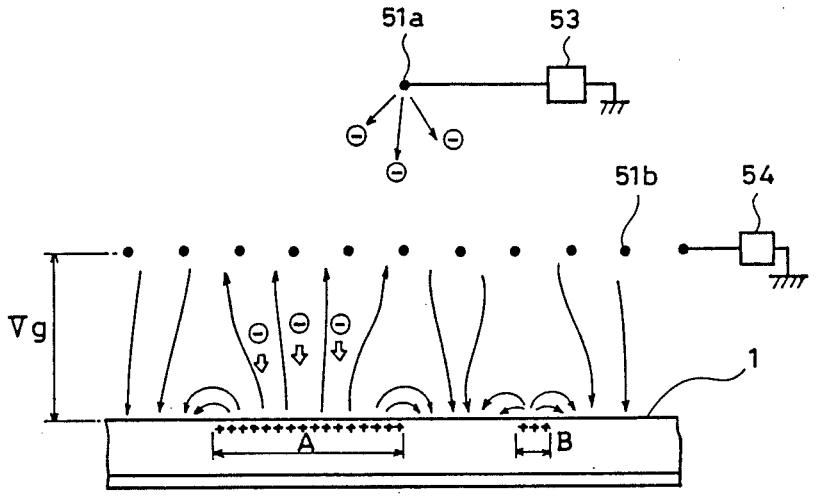
FIG. 8 shows a drawing for explaining the principle in forming the latent electrostatic image.

Thereafter, at the portion opposing the developing unit, toner is supplied to said latent electrostatic images $A_0'$ and $B_0'$ from a developing sleeve to which a developing bias voltage $V_b$ higher than said grid voltage $V_g$ is applied, as shown in FIG. 7C. The toner images are transferred onto a copying paper P to obtain the outline images of FIG. 6.

(c) Main flow of the copying machine

Figure 9:
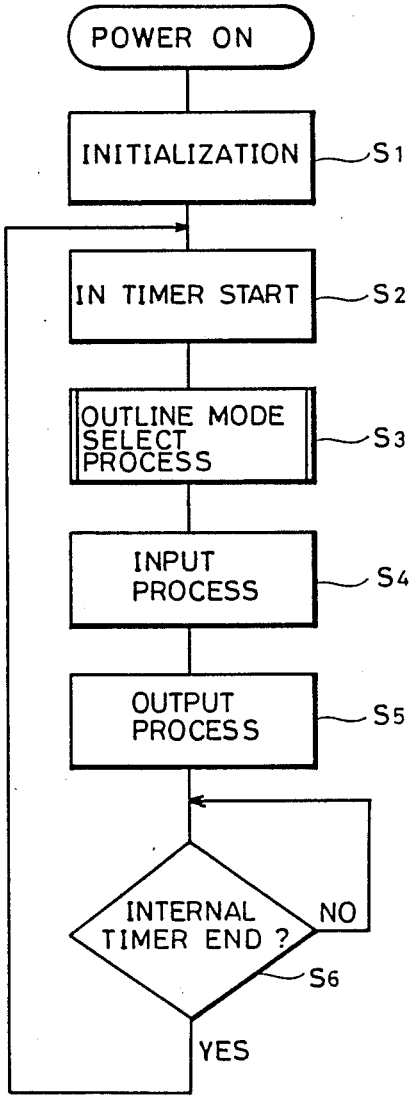
FIG. 9 is a flow chart showing a main routine of the copying machine in accordance with one embodiment of the present invention.

FIG. 9 is a main flow chart of the CPU 100 shown in FIG. 4 in relation to the operation of the copying machine. When the power is turned on, the internal register and various timers are initialized (step S1) and an internal timer defining the time of the main routine is started (step S2).

In the step S3, the control for selecting the outline mode, which will be described later, is carried out. Thereafter, input processes (step 4) and output processes (step S5) in association with the copying operation are carried out, and when the internal timer is terminated (step S6), the flow returns to the step S2.

(d) Flow of the outline mode

Figure 10A:
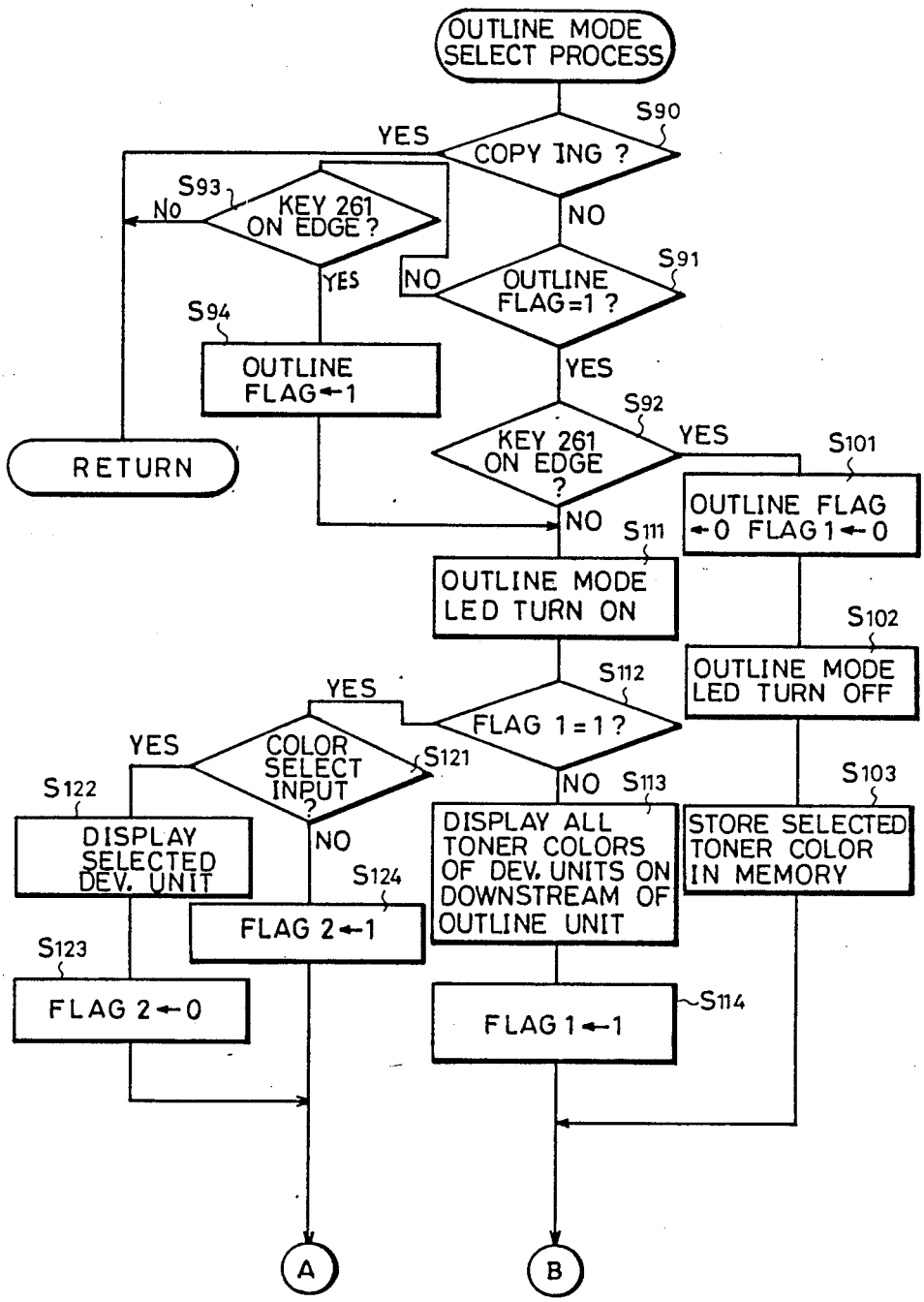
FIGS. 10A and 10B are flow charts concretely showing the steps of the outline mode selecting process in FIG. 9.
Figure 10B:
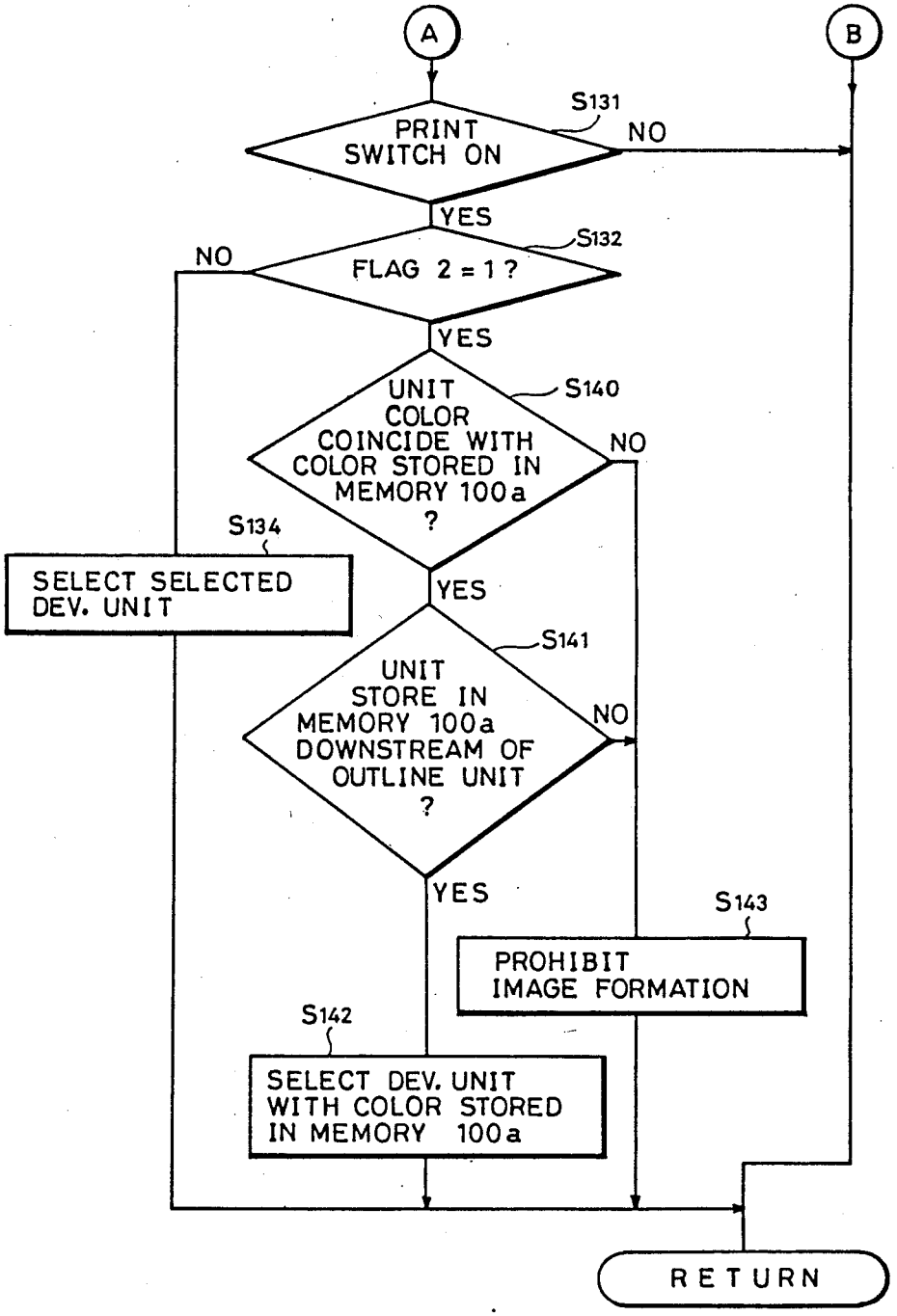

FIGS. 10A and 10B show the flow of the subroutine of the outline mode selecting process shown in the step S3 of FIG. 9. In the process of the subroutine, when the outline mode is selected, the colors of the toners of the developing devices which can be selected are displayed on the operation panel 200, and it is ready for the copying operation. By pressing the color select key 251, a copy is provided by the developing device of a selected color. When he print key 201 is pressed without pressing the color select key, the copy is carried out with the developing unit selected before the selection of the outline mode. However, if the developing unit selected before the selection of the outline mode is detached from the body or the unit is not on the downstream side of the outline unit in the direction of rotation of the photoreceptor drum, the copying operation is prohibited. In this flow, the flag 1 is set at "1" when the outline mode is selected, and the flag 2 is set at "1" when there is no color select input.

In the step S90, whether the copying operation is being carried out or not is determined. If the copying operation is not being carried out, the outline flag indicating whether the outline mode is selected or not is checked in the step S91. When the outline flag is "1", namely, the operation is now in the outline copy mode, the flow proceeds to the step S92, and if the outline flag is "0", that is, the normal copy mode, the flow proceeds to the step S93. In the step S92, it is determined whether an ON edge of the outline mode select key 261 is detected or not. Now, the ON edge means the change of the state of the key from OFF to ON. If the ON edge of the key 261 is detected in the step S92, the outline flag is set at "0" and the flag 1 is set at "0" in the step S101 to cancel the outline copy mode, and the outline mode LED 202 is turned off in the step S102. Then, the color of the toner which is presently selected is written in the memory (RAM) 100*a* of the CPU 100 of 1 chip microprocessor (step S103), and the subroutine is ended.

Meanwhile, if it is determined that the operation is not in the outline copy mode in the step S91, whether the ON edge of the outline mode select key 261 is detected or not is checked in the step S93, and if the ON edge is detected, the flow proceeds to the step S94. In the step S94, the outline flag is set at "1" to set the outline copy mode, and the flow proceeds to the step S111. In the step S111, the outline mode LED 202 indicating that the outline copying mode is set is turned on.

In the step S112, it is checked whether the flag 1 indicating the outline mode is set at "1" or not. When the outline mode select key 201 is pressed at the start, it is assumed that the flag has not been set. If it is NO in the step S112 the flow proceeds to the step S113 and the colors of the toners of all developing units on the downstream side of the outline unit are displayed by the LEDs 252*a* to 252*f* of the operation panel 200. In the step S114 the flag 1 is set at "1", and the subroutine is ended. By this operation, all colors of the developing units which can be used when the outline mode is selected are displayed.

If it is YES in the step S112, the flow proceeds to the step S121, and whether the color selection was done or not after the selection of the outline mode is checked by the color select switch 251 on the operation panel 200. If it is NO, the flag 2 is set at "1" in the step S124. If it is YES in the step S121, the flow proceeds to the step S122, and the developing unit selected by the color select switch 251 is indicated by turning on the corresponding one of the color display LEDs 252*a* to 252*f* on the operation panel 200. In the step S123 the flag 2 is set at "0". The color selection is carried out by the color select switch 251 after the colors of the toners which can be selected are all displayed on the operation panel 200 (see step S113). Therefore, the user has only to select the developing unit in accordance with the display on the operation panel 200.

The selecting operation will be described with reference to FIGS. 11A to 11D.

Figure 11A:
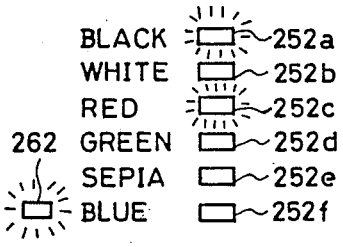
FIGS. 11A to 11D show the states of a display displaying color selection and outline mode selection.
Figure 11B:
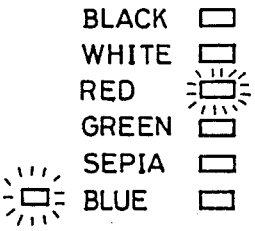

Let us assume that the outline unit 50 is mounted on the mounting portion at the upper stage, a developing unit 7 with red toner is mounted on the mounting portion at the middle stage, and the developing unit 8 with black toner is mounted on the mounting portion at the lower stage. If the outline mode is selected in this state, the colors of the toner in the developing units 7 and 8 on the downstream side of the outline unit are displayed as shown in FIG. 11A (step S113). When the color select key 251 is pressed, the colors of the toner on the downstream side of the outline unit 50 are successively displayed (step S122). FIG. 11B shows a state in which the developing unit 7 with red toner is selected.

Figure 11C:
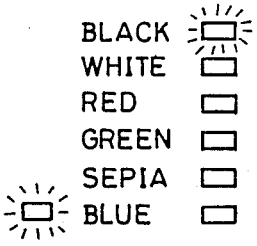

If the outline mode is set when the developing unit 6 with red toner is mounted at the upper stage, the outline unit 50 is mounted at the middle stage and the developing unit 8 with black toner is mounted at the lower stage, only the color of the black toner on the downstream side of the outline unit 50 is displayed as shown in FIG. 11C.

Figure 11D:
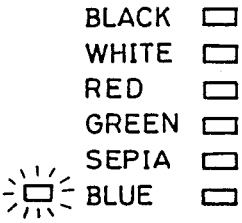

If the outline mode is selected when the outline unit 50 is mounted at the lower stage, the color of the toner is not displayed as shown in FIG. 11D, since there is no developing unit on the downstream side of the outline unit 50. This means that the copying operation can not be carried out in the outline mode.

Referring to FIG. 10B, whether the image forming operation is started or not by the print switch 201 is checked in the step S131, and if it is NO, this subroutine is ended. If it is YES, whether the flag 2 is set at "1" or not is checked in the step S132. When it is YES, that is, the color is not selected after the selection of the outline mode in the step S100 and before the turning on of the print switch, whether the developing unit of the color stored in the memory 100*a* is mounted on any of the mounting portions or not is determined in the step S140. If it is not mounted, the copying operation is prohibited in the step S143. If it is determined that the unit is mounted in the step S140, whether the developing unit stored in the memory 100*a* is positioned on the downstream side of the outline unit in the direction of rotation of the photoreceptor drum or not is determined in the step S141. If it is NO, the flow proceeds to the step S143, and if it is YES, the flow proceeds to the step 142. In the step S142, the color of the toner stored in the memory 100*a*, namely, the toner color of the developing unit selected before the selection of the outline mode is displayed and selected, thereby ending the subroutine. In this process, if printing is started with the outline mode selected and the color select key 251 not pressed, the generation of miscopy can be prevented by using the developing unit which is selected before the selection of the outline mode. If it is NO in the step S132, the flow proceeds to the step S134, and the developing unit selected by the color select switch 251 (step S122) is selected, and the subroutine is ended.

When the subroutine is ended the flow returns to the main flow of FIG. 9. If the outline mode is selected in the above described subroutine, the signal indicating the developing unit selected in the above described manner is inputted to the CPU 100. In the output process (S4), the signal indicating that developing unit is outputted to drive the developing unit, providing the copy of the desired color in the outline mode.

In this embodiment, even if the print switch 201 is pressed without the color select input in the outline mode, the color of the toner selected before the selection of the outline mode has been stored in the memory 100*a* and the development is carried out in that color. Various other methods are proposed. For example, the color of the selected toner may be written in the memory 100*a* after the step S134. The color most frequently used in development may be checked and stored in the memory 100*a*. The color most frequently used in the outline mode may be checked and written in the memory 100*a*. If the print switch 201 is pressed without the color selection, and the developing unit containing the toner of the color stored in the memory 100 is not mounted, the state may be indicated to prevent image formation or to stand by for the start of the image formation. In the above described embodiment, the number of the mounting portions is three. However, the number of the mounting portions is not limited and the present invention may be applied to copying machines having any other plurality of mounting portions.

Although the present invention is applied to a copying machine capable of selecting outline mode in the above described embodiment, the present invention may be applied to copying machines capable of forming normal image and other types of images to provide the same effect.

If the outline mode is selected, the colors of the developing devices which can be used in the outline mode are displayed. Therefore, the user can check which colors can be used at one sight, whereby the trouble in the operation is eliminated, and the generation of miscopies can be suppressed.

If the copying operation is started without selecting the color of the developing device after the selection of the outline mode, the copying operation is carried out by selecting the developing device of the color determined by a prescribed system, whereby miscopies can be reduced. Generally, the color of the toner of the developing unit selected before the selection of the outline mode is frequently used. Therefore, if it is adapted to select the color of the toner selected before the selection of the outline mode, it is convenient in operation.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus comprising:

a movable photoreceptor;

image forming means for forming a latent electro static image on said photoreceptor;

a plurality of mounting portions provided in the vicinity of said photoreceptor and along a direction of movement of said photoreceptor;

a plurality of developing units each of which can be mounted on said on and detached from each of said mounting portions, each said developing unit developing the latent electrostatic image on the photoreceptor in a developing color, when each said developing unit is mounted on ay one of said mounting portions;

an outline unit which can be mounted on and detached from each of said mounting portions for forming a latent electrostatic image with outline portions emphasized by applying charges to the latent electrostatic image on said photoreceptor formed by said image forming means, when said outline unit is mounted on any one of said mounting portions;

detecting means for detecting a mounting position of said outline unit being mounted and a developing color and a mounting position of at least one of said developing units being mounted;

mode selecting means for selecting an output copying mode;

developing color selecting means for selecting one from said at least one developing unit detected by said detecting means in accordance with the developing color thereof;

display means for displaying a developing color of at least one of said developing units mounted on the downstream side of the mounting position of said outline unit in the direction of movement of said photoreceptor, based on an output from said detecting means, when the outline copying mode is selected by said mode selecting means;

memory means for storing a developing color of that developing unit which has been selected by said developing color selecting means before the outline copying mode is selected by said mode selecting means; and control means for operating, when the developing unit is selected by said developing color selecting means after the outline mode is selected by said mode selecting means, the outline unit and the selected developing unit to carry out a copying operation, and for operating, when the developing unit is not selected by said developing color selecting means after the outline mode is selected by said mode selecting means, the outline unit and the developing unit of the developing color stored in the memory means to carry out the copying operation.

2. An electrostatic copying apparatus comprising:

a movable photoreceptor;

image forming means for forming a latent electrostatic image on said photoreceptor;

a plurality of mounting portions provided in the vicinity of said photoreceptor and along a direction of movement of said photoreceptor;

a plurality of developing units each of which can be mounted on and detached from each of said mounting portions, for developing the latent electrostatic image on the photoreceptor in a developing color, when each said developing unit is mounted on any one of said mounting portions;

an outline unit which can be mounted on and detached from each of said mounting portions for forming a latent electrostatic image with outline portions emphasized by applying charges on the latent electrostatic image on the photoreceptor, when mounted to any one of said mounting portions;

mode selecting means for selecting an outline copying mode;

developing color selecting means for selecting one of at least one of said developing units which is mounted to any one of said mounting portions; and control means for operating, when the developing unit is selected by said developing color selecting means after the outline mode is selected by said mode selecting means, the outline unit and the selected developing unit to carry out a copying operation, and for operating, when the developing unit is not selected by said developing color selecting means after the outline mode is selected by said mode selecting means, the outline unit and a prescribed developing unit out of the developing units mounted on said mounting portions to carry out the copying operation.

3. An electrophotographic copying apparatus comprising:

a movable photoreceptor;

a plurality of mounting portions provided in the vicinity of said photoreceptor and along a direction of movement of said photoreceptor;

first image forming means which can be mounted on and detached from each of said mounting portions, for forming a first latent electrostatic image on said photoreceptor when said first image forming means is mounted on any of said mounting portions;

a plurality of developing units each of which can be mounted on and detached from each of said mounting portions, for developing the latent electrostatic image formed on said photoreceptor when each said developing unit is mounted on any one of said mounting portions;

detecting means for detecting a mounting position of said first image forming means being mounted, and at least one of said developing units mounted on the downstream side of the mounting position of said first image forming means in the direction of movement of said photoreceptor;

unit determining means for determining one of said at least one developing units detected by said detecting means;

mode defining means for defining a copying mode by said first image forming means; and control means for activating said first image forming means in response to an output of said mode defining means and for developing said first latent electrostatic image by using the developing unit determined by said unit determining means.

4. An electrophotographic copying apparatus according to claim 3 further comprising a second image forming means forming a second latent electrostatic image on said photoreceptor, said first latent electrostatic image comprising a latent electrostatic image with outline portions emphasized by applying charges to the second latent electrostatic image formed by said second image forming means.

5. An electrophotographic copying apparatus according to claim 3, wherein each of said developing units comprises toner of a different developing color each said developing unit developing the latent electrostatic image with the developing color based on its respective toner color, said detecting means detecting the developing color of the developing unit.

6. An electrophotographic copying apparatus according to claim 5, wherein said unit determining means comprises:

display means for displaying at least one of said developing units detected by said detector means by at least one developing color and selecting means for selecting and determining an arbitrary developing color out of said at least one developing color displayed by said display means.

7. An electrophotographic copying apparatus according to claim 5, wherein said unit determining means comprises:

memory means for storing a prescribed developing color; and determining means for determining whether said prescribed developing color stored in said memory means coincides with any of said at least one developing color detected by said detecting means; and for determining the developing unit having said prescribed developing color stored in said memory means in response to an output indicating the coincidence from said determining means.

* * * * *

UNITED STATES PATENT AND TRADEMARK OFFICE

CERTIFICATE OF CORRECTION

PATENT NO. : 4,868,605

DATED : September 19, 1989

INVENTOR(S) : Keiji Kusumoto

It is certified that error appears in the above-identified patent and that said Letters Patent is hereby corrected as shown below:

In col. 3, line 37, delete "one".

In col. 3, line 40, after "show", insert -- changes of --.

In col. 3, line 41, before "a photoreceptor", insert -- images on --.

In col. 3, line 50, after "display", insert -- panel --.

In col. 5, line 16, change "arranged" to -- . Arranged --.

In col. 6, line 56, change "he" to -- the --.

In col. 9, line 11, change "image" to -- images --.

In col. 9, line 41, change "electro" to -- electro- --.

In col. 9, line 47, delete "on said".

In col. 9, line 51, change "ay" to -- any --.

In col. 12, line 8, after "color", insert -- , -- (comma).

UNITED STATES PATENT AND TRADEMARK OFFICE

CERTIFICATE OF CORRECTION

PATENT NO. : 4,868,605

DATED : September 19, 1989

INVENTOR(S) : Keiji Kusumoto

It is certified that error appears in the above-identified patent and that said Letters Patent is hereby corrected as shown below:

In col. 12, line 18, after "color", insert -- ; -- (semicolon).

Signed and Sealed this

Eighteenth Day of September, 1990

*Attest:*

HARRY F. MANBECK, JR.

*Attesting Officer*

*Commissioner of Patents and Trademarks*